US008413550B2

(12) United States Patent
Hu

(10) Patent No.: US 8,413,550 B2
(45) Date of Patent: Apr. 9, 2013

(54) DUSTPROOF DEVICE FOR RATCHET WRENCH

(76) Inventor: Bobby Hu, Taichung (TW)

( * ) Notice: Subject to any disclaimer, the term of this patent is extended or adjusted under 35 U.S.C. 154(b) by 447 days.

(21) Appl. No.: 12/878,073

(22) Filed: Sep. 9, 2010

(65) Prior Publication Data

US 2011/0308359 A1 Dec. 22, 2011

(30) Foreign Application Priority Data

Jun. 17, 2010 (TW) ..... 99119696 A

(51) Int. Cl.
*B25B 13/46* (2006.01)

(52) U.S. Cl. ..... 81/63; 81/60; 81/61; 81/62; 81/63.1; 81/63.2

(58) Field of Classification Search ..... 81/60–63, 81/63.1, 63.2
See application file for complete search history.

(56) References Cited

U.S. PATENT DOCUMENTS 5,533,427 A * 7/1996 Chow ..... 81/63.2
5,887,493 A * 3/1999 Main ..... 81/57.29

* cited by examiner

*Primary Examiner* — Monica Carter
*Assistant Examiner* — Danny Hong
(74) *Attorney, Agent, or Firm* — Alan Kamrath; Kamrath IP Lawfirm, P.A.

(57) ABSTRACT

A ratchet wrench (10) includes a head (12) having a compartment (121) rotatably receiving a drive member (12). An annular groove (126) is formed in an inner periphery of the compartment (121) and in communication with a recess (13) formed in a side (F2) of the head (12). A flange (2121) is formed on an outer periphery of the drive member (21) and intermediate a toothed portion (213) of the drive member (21) and an annular groove (214) formed in the outer periphery of the drive member (21). A flange (2121) is formed on the outer periphery of the drive member (21) and includes an inner end face (2122) facing a bottom face (133) of the recess (13). A C-clip (24) is received in the annular grooves (126, 214) and has two clamping portions (241) received in the recess (13). A dustproof cap (30) engaged in the recess (13) and located intermediate a bottom face (133) and the recess (13) and the inner end face (2122) of the flange (2121). The dustproof cap (30) covers the clamping portions (241) of the C-clip (24) and covers and seals the recess (13).

11 Claims, 9 Drawing Sheets

DUSTPROOF DEVICE FOR RATCHET WRENCH

BACKGROUND OF THE INVENTION

The present invention relates to a dustproof device for a ratchet wrench and, more particularly, to a dustproof cap mounted in a recess in a side of a head of a ratchet wrench to prevent dust and debris from entering a gap between the head and a driving member rotatably received in the head.

FIGS. 1A and 1B show a conventional ratchet wrench 10' including a head 12 connected to an end of a handle 11. The head 12 includes first and second sides F1 and F2. A compartment 121 extends from first side F1 through second side F2 and rotatably receives a driving device 2. A recess 13 is formed in second side F2 and in communication with compartment 121. Compartment 121 has an opening in first side F1, which opening having a diameter smaller than compartment 121, forming an annular end wall 122. A first groove 124 is formed in an inner periphery of compartment 121. A second groove 125 is formed in a wall of second groove 124 and has an opening in first side F1. First groove 124 is intermediate second groove 125 and compartment 121. First groove 124 is spaced from recess 13 by a partitioning wall 123. An annular groove 126 is formed in the inner periphery of compartment 121 and is at the same level as and in communication with recess 13. Driving device 2 includes a drive member 21 having a lower, coupling portion 211. Drive member 21 further includes an upper, cylindrical portion having a larger diameter. A toothed portion 213 is formed on an outer periphery of the cylindrical portion. A stepped portion 212 is formed at an intersection of the cylindrical portion and coupling portion 211. An annular groove 214 is formed in the outer periphery of the cylindrical portion and between stepped portion 212 and toothed portion 213 and aligned with annular groove 126 and recess 13. Drive member 21 includes a longitudinal through-hole 2151 with an enlarged section 2152. A push rod 20 is received in through-hole 2151 and includes a smaller actuating section 201. A spring 202 is mounted in enlarged section 2152 and around actuating section 201. A ball 23 is mounted in coupling portion 211 for engagement with a workpiece such as a socket. Push rod 20 can be pushed to release ball 23, allowing disengagement of the workpiece from coupling portion 211. Drive member 21 is received in compartment 121 with a top edge abutting an inner face of annular end wall 122 and with toothed portion 213 aligned with first groove 124. At least one pawl 22 is received in the first groove 124 and supported by partitioning wall 123. Pawl 22 includes a toothed portion 221 and an arcuate actuation portion 222. A switch 15 is rotatably received in second groove 125 and includes a stem 151 extending beyond first side F1 for manual operation. Switch 15 further includes an actuation end 152 abutting against actuation portion 222. When stem 151 is manually rotated between two positions, actuation portion 222 is actuated such that toothed portion 221 is selectively in one of first and second engagement relations with toothed portion 213 to allow drive member 21 to drive an object coupled with coupling portion 211 in one of two opposite directions. A C-clip 24 is mounted in annular grooves 214 and 126 and includes two hook-shaped clamping portions 241 received in recess 13. Drive member 21 is rotatably retained in compartment 121 by C-clip 24. A user can use a pair of pliers to release C-clip 24 from annular grooves 214 and 126 and recess 13 by clamping one of clamping portions 241, allowing removal of drive member 21 from compartment 121 for maintenance.

However, dust and debris D will accumulate in exposed recess 13 and enter compartment 121 along a path indicated by arrows shown in FIG. 2. Dust and debris D entering a gap between toothed portions 213 and 221 will cause abrasion and damage to toothed portions 213 and 221, leading to malfunction of ratchet wrench 10'. Dustproof device in recess 13 is, thus, required.

U.S. Pat. No. 5,533,427 discloses a ratchet wrench having a retaining plate engaged with a bottom surface of a pawl. A clamping ring is mounted below the retaining plate and has an ear. The retaining plate supports the pawl, which is similar to portioning wall of ratchet wrench 10' in FIGS. 1A and 1B. However, the retaining plate must be made of metal. Furthermore, dust and debris can accumulate in a location outside of the clamping ring and then enter a gap between a ratchet wheel and the pawl via the ear, failing to provide satisfactory dustproof effect.

Thus, a need exists for a reliable, inexpensive ratchet wrench with reliable dustproof effect.

BRIEF SUMMARY OF THE INVENTION

The present invention solves this need and other problems in the field of dustproof ratchet wrenches by providing, in a preferred form, a ratchet wrench including a handle and a head connected to an end of the handle. The head includes first and second sides spaced in a thickness direction perpendicular to the longitudinal axis of the handle. A compartment extends from the second side towards the first side. A first groove is formed in the inner periphery of the compartment. The head further includes a second groove in communication with the first groove. A recess is formed in the second side of the head. A first annular groove is formed in the inner periphery of the compartment and in communication with the recess. The recess includes a bottom face intermediate the first and second sides in the thickness direction. The recess further includes a peripheral face extending perpendicularly to the bottom face. A drive member is rotatably received in the compartment. The drive member includes an outer periphery with a toothed portion. The drive member further includes a coupling portion adapted to engage with an object to be driven. A second annular groove is formed in the outer periphery of the drive member and aligned with the first annular groove. A flange is formed on the outer periphery of the drive member and intermediate the coupling portion and the second annular groove. The flange includes an inner end face facing the bottom face of the recess. The second annular groove is located intermediate the inner end face of the flange and the toothed portion. A C-Clip is received in the first and second annular grooves and rotatably retaining the drive member in the compartment. The C-clip (24) includes two clamping portions received in the recess. A pawl is slideably received in the first groove. The pawl is selectively in one of first and second engagement relations with the toothed portion to allow the drive member to drive an object coupled with the coupling portion in one of two opposite directions. A switch is received in the second groove and operatively connected to the pawl. The switch is rotatable to move the pawl to be selectively in the first or second engagement relation with the toothed portion of the drive member. A dustproof cap is engaged in the recess and located intermediate the bottom face of the recess and the inner end face of the flange. The dustproof cap covers the two clamping portions of the C-clip and covers and seals the recess.

In preferred forms, the recess further includes an engaging groove formed in the peripheral face. The engaging groove includes a first side wall extending from and coplanar to the bottom face. The engaging groove further includes a second side wall parallel to and spaced from the first side wall. The engaging groove further includes an arcuate end wall extending between the first and second side walls. The second side wall extends perpendicularly between the arcuate end wall and the peripheral face. The dustproof cap includes first and second faces spaced in the thickness direction. The second face of the dustproof cap includes two evasive grooves receiving the clamping portions of the C-clip. The dustproof cap further includes first and second edges extending between the first and second faces. The first edge is arcuate and has two ends. The second edge is arcuate and extends between the ends of the first edge. A protrusion is formed on the first edge and engaged in the engaging groove. The protrusion abuts the arcuate end wall and the second side wall. The second edge abuts the outer periphery of the drive member. The first face of the dustproof cap abuts the inner end face of the flange. The first edge abuts the peripheral face. The flange includes an outer peripheral face extending perpendicularly to the inner end face of the flange. The outer peripheral face of the flange is located intermediate the first and second edges along the longitudinal axis of the handle. The outer peripheral face of the flange includes a chamfered face.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1B:
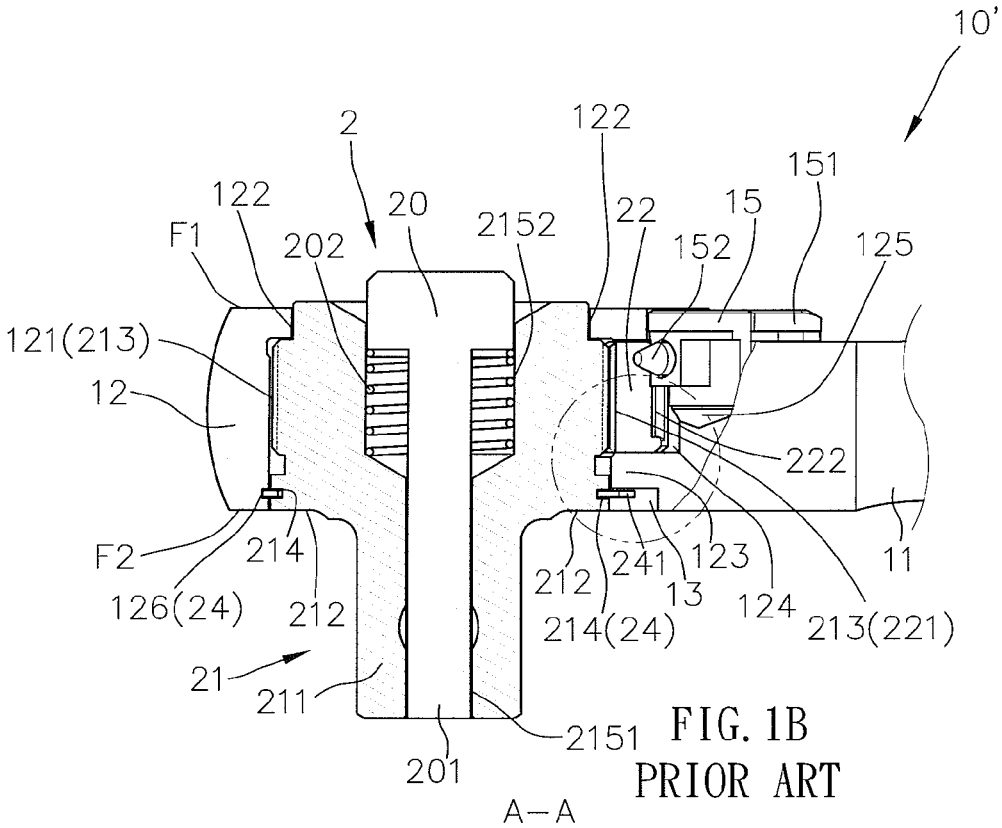
FIG. 1B PRIOR ART
FIG. 1B shows a partial, cross-sectional view of the ratchet wrench of FIG. 1A according to section line A-A of FIG. 1A.
Figure 1A:
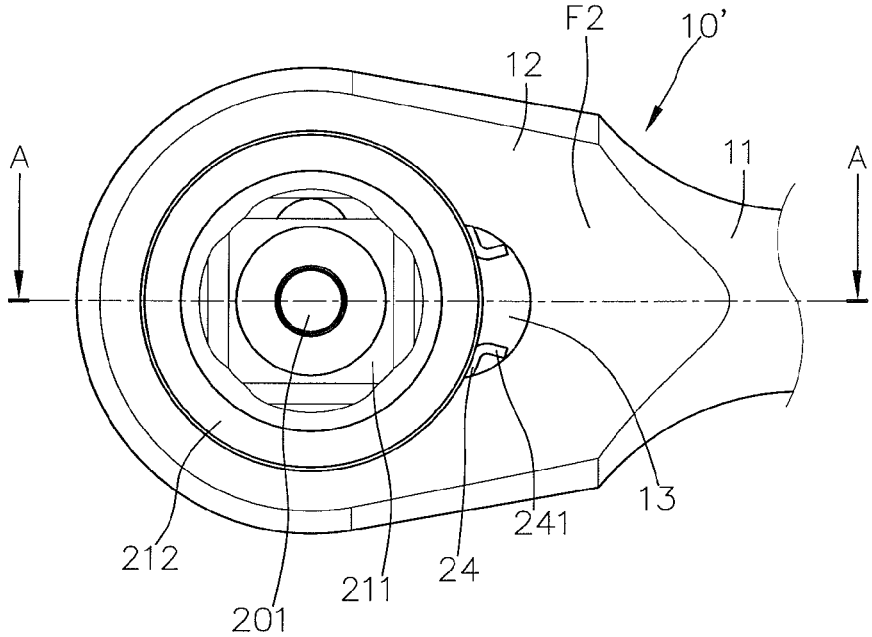
FIG. 1A PRIOR ART
FIG. 1A shows a partial, bottom view of a conventional ratchet wrench.
Figure 2:
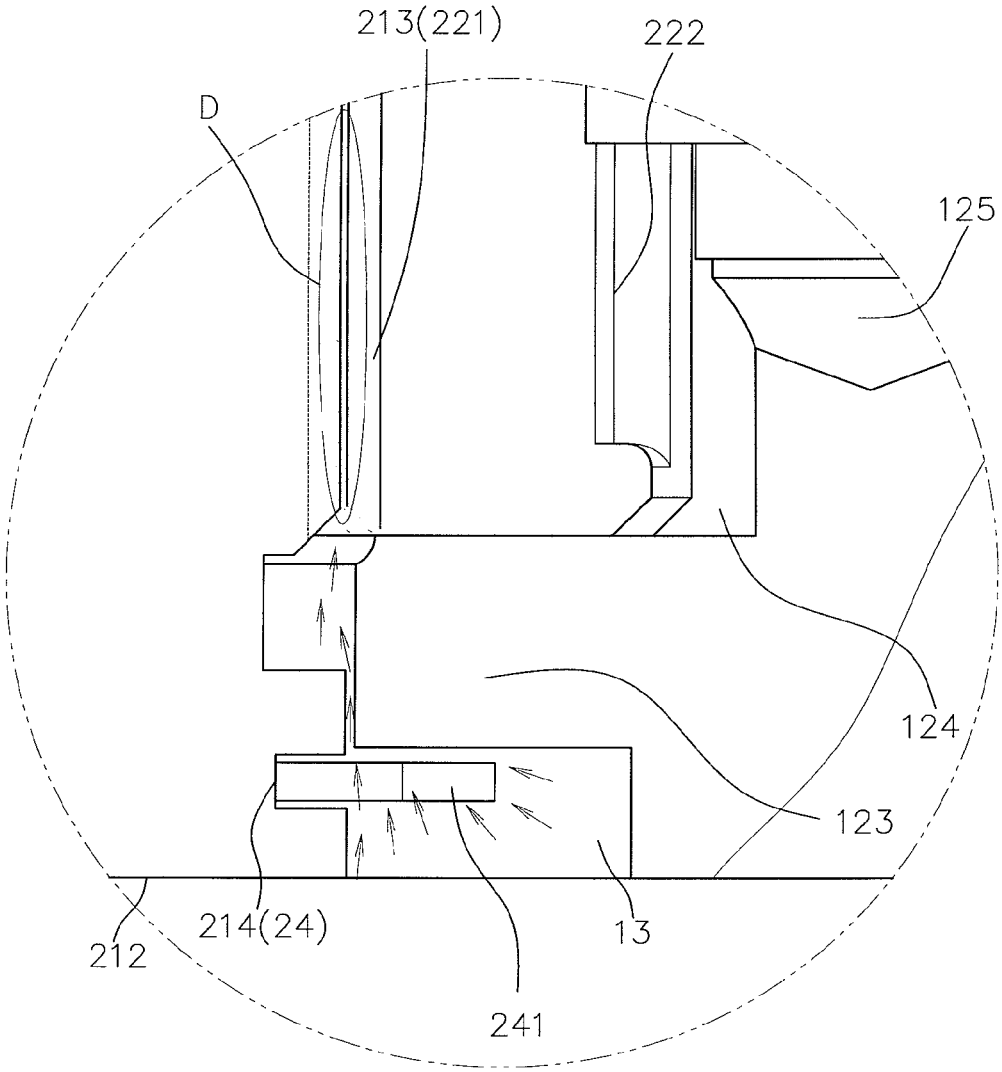
FIG. 2 PRIOR ART
FIG. 2 shows an enlarged view of a circled portion of FIG. 1B.
Figure 3B:
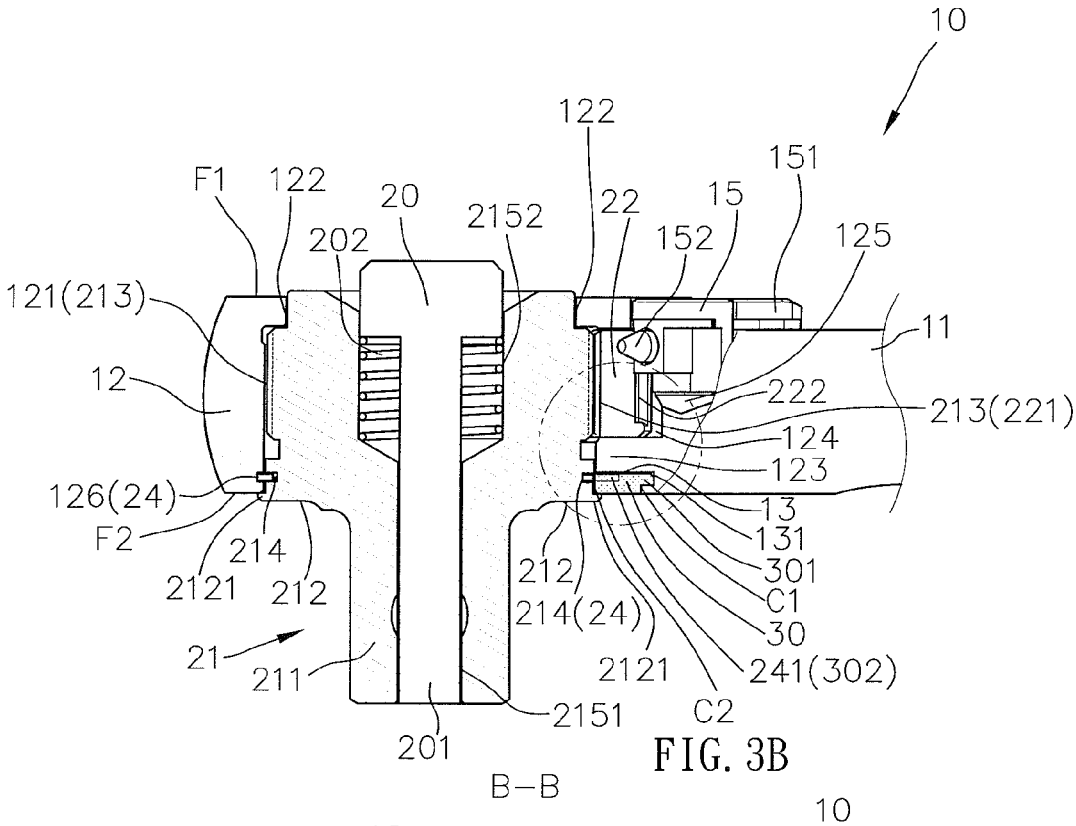
FIG. 3B shows a partial, cross-sectional view of the ratchet wrench of FIG. 3A according to section line B-B of FIG. 3A.
Figure 3A:
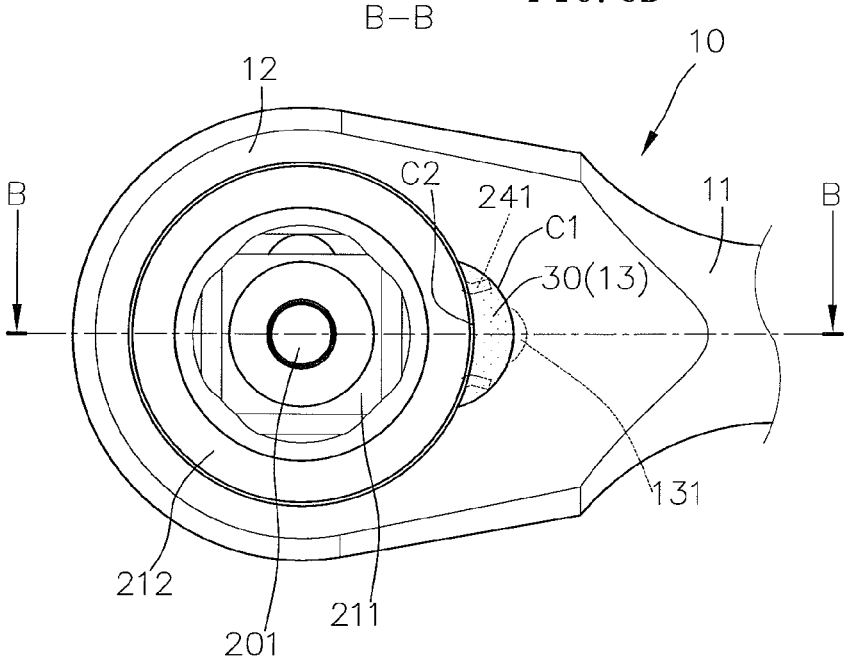
FIG. 3A shows a bottom, perspective view of a ratchet wrench of an embodiment according to the preferred teachings of the present invention.
Figure 4:
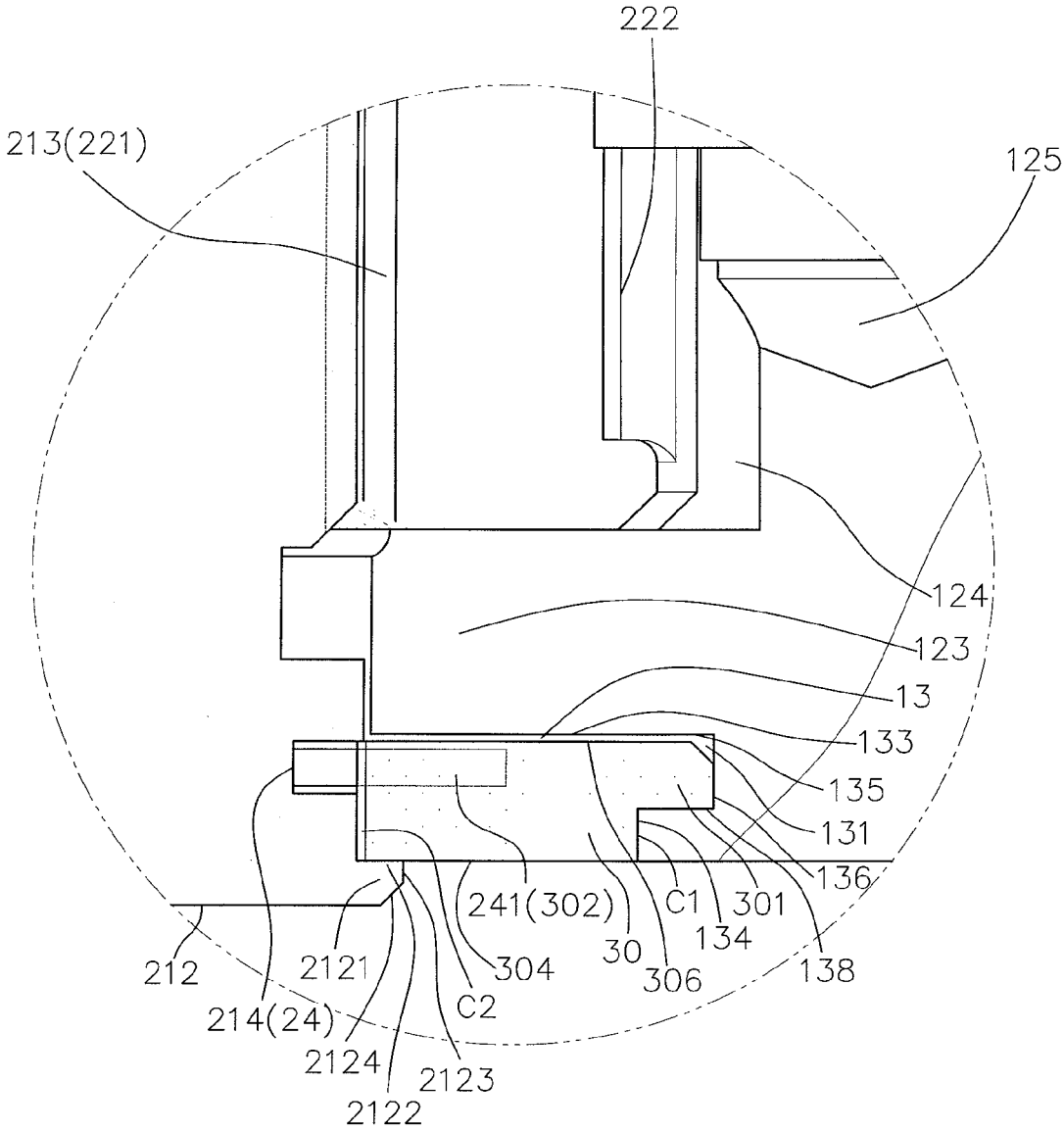
FIG. 4 shows an enlarged view of a circled portion of FIG. 3B.
Figure 5:
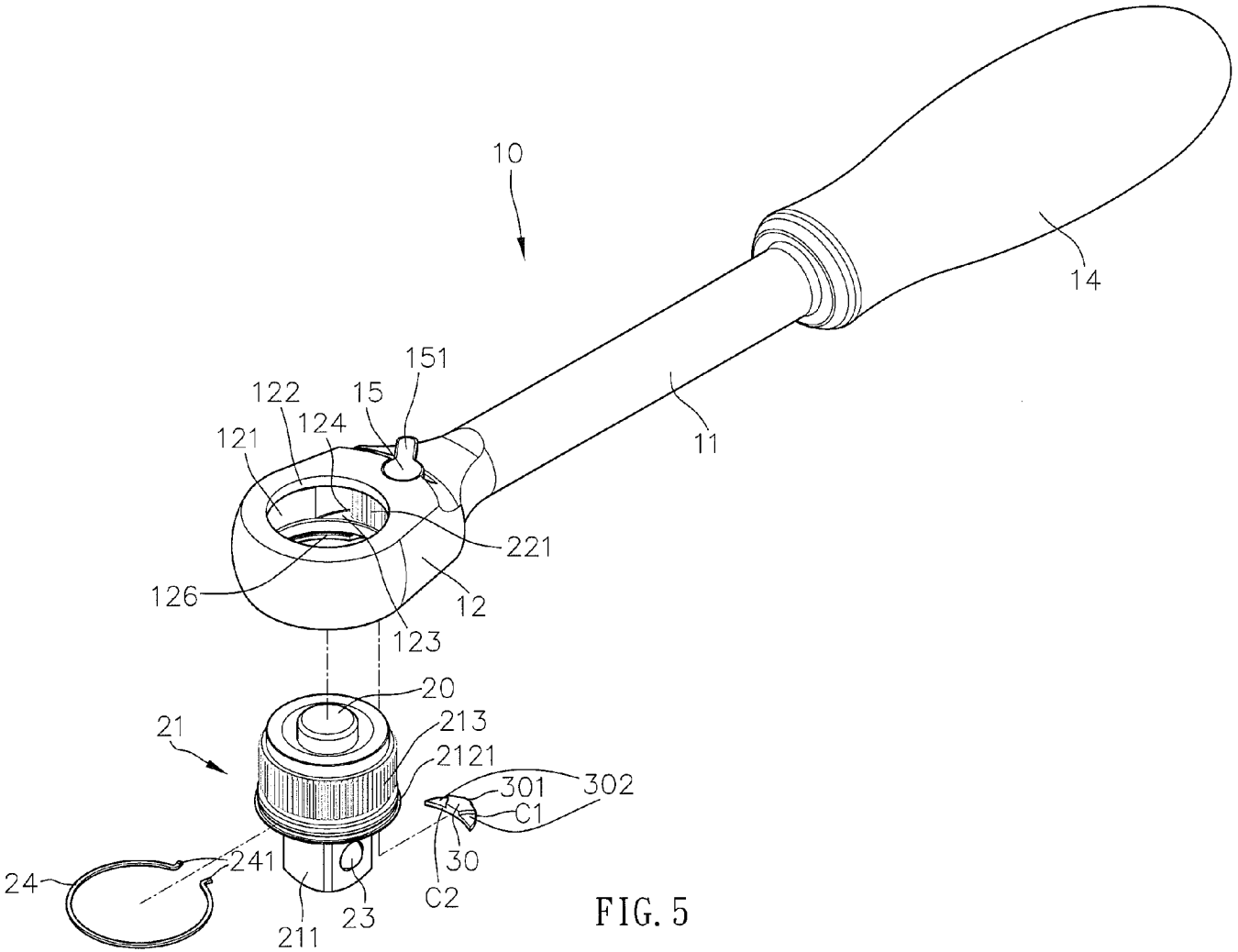
FIG. 5 shows an exploded, perspective view of the ratchet wrench of FIG. 3A.
Figure 6A:
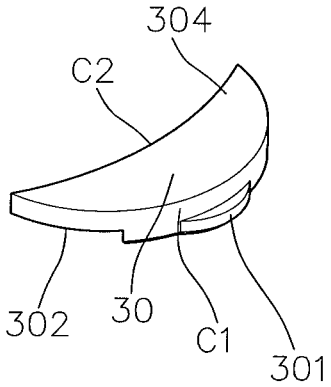
FIG. 6A shows a perspective view of a dustproof cap of the ratchet wrench according to the preferred teachings of the present invention.
Figure 6B:
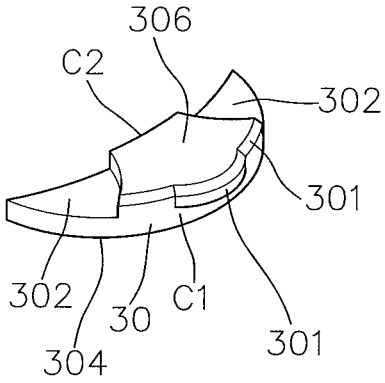
FIG. 6B shows another perspective view of the dustproof cap of FIG. 6A.
Figure 7:
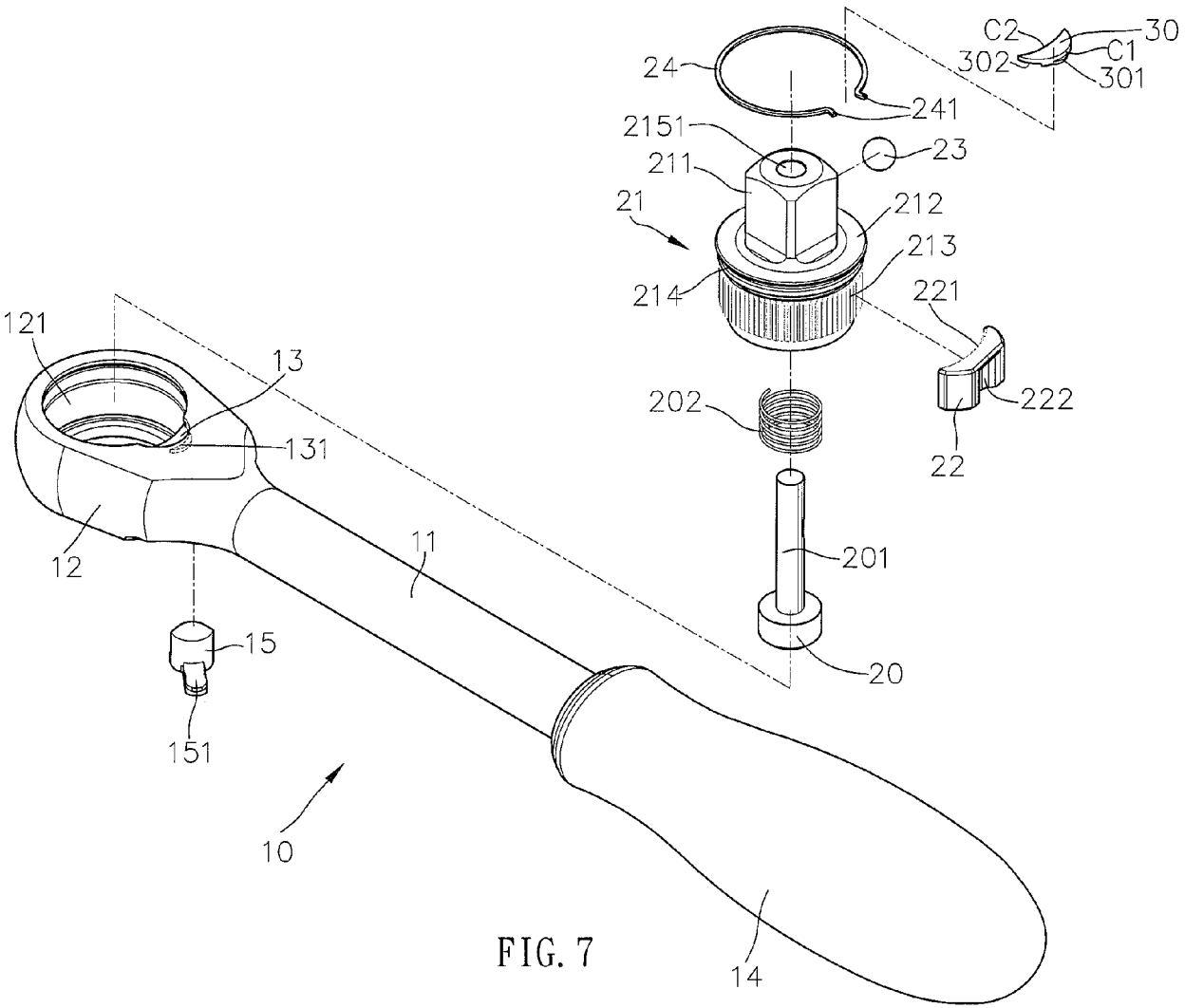
FIG. 7 shows another exploded, perspective view of the ratchet wrench of FIG. 3A.
Figure 8:
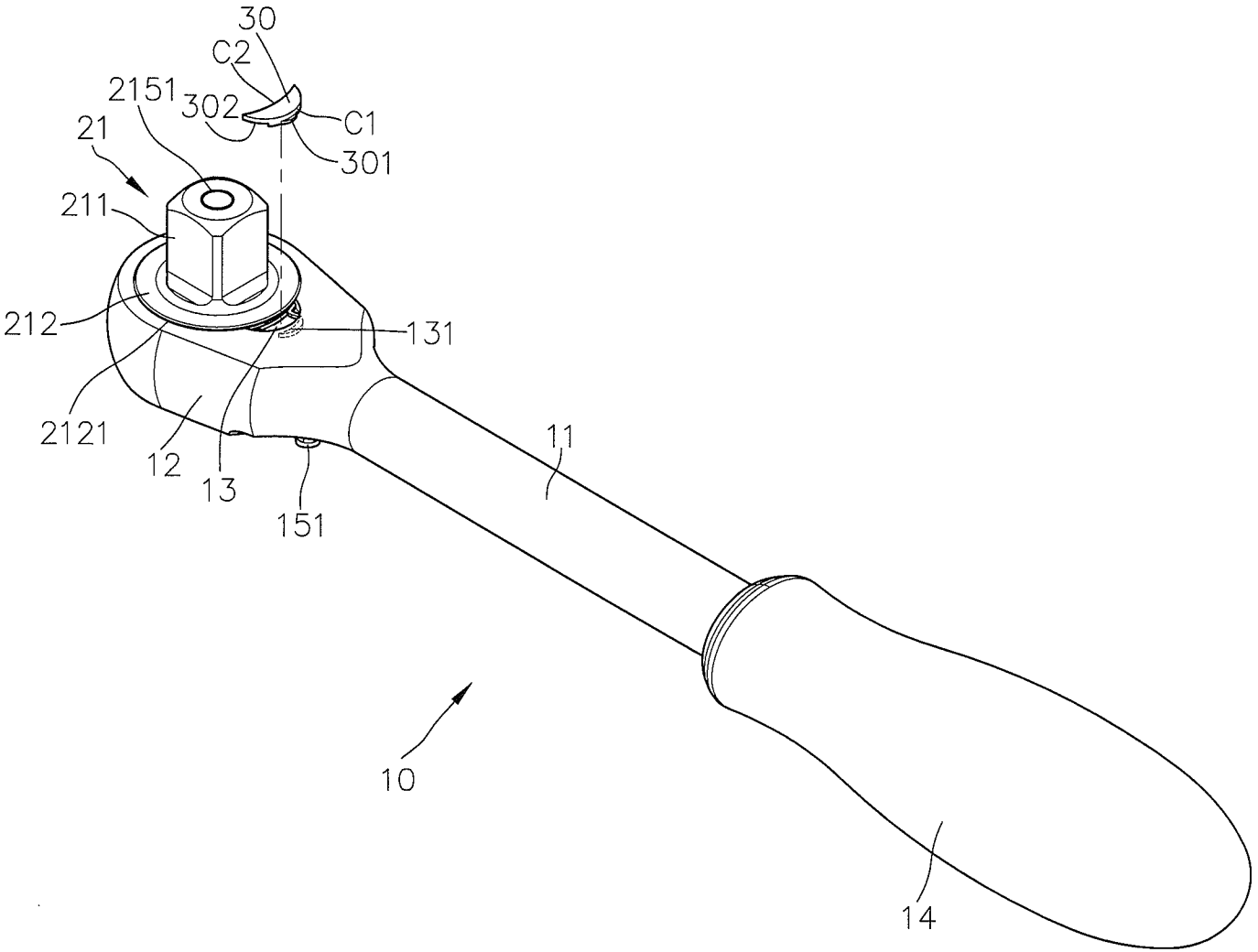
FIG. 8 shows a perspective view of the ratchet wrench of FIG. 3 with the dustproof cap exploded.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "side", "end", "portion", "section", "longitudinal", "annular", "depth", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIGS. 3A, 3B, and 4-8 show a ratchet wrench 10 with a dustproof device of an embodiment according to the preferred teachings of the present invention. Ratchet wrench 10 includes a head 12 connected to an end of a handle 11. Handle 11 includes a gripping portion 14 spaced from the end of handle 11 along a longitudinal axis of handle 11. The head 12 includes first and second sides F1 and F2 spaced in a thickness direction perpendicular to the longitudinal axis of handle 11. A compartment 121 extends from first side F1 through second side F2. A recess 13 is formed in second side F2 and in communication with compartment 121. Compartment 121 has an opening in first side F1, the opening having a diameter smaller than compartment 121, forming an annular end wall 122. A first groove 124 is formed in an inner periphery of compartment 121. A second groove 125 is formed in a wall of first groove 124 and has an opening in first side F1. First groove 124 is intermediate second groove 125 and compartment 121 along the longitudinal axis of handle 11. First groove 124 is spaced from recess 13 by a partitioning wall 123. An annular groove 126 is formed in the inner periphery of compartment 121 and is at the same level as and in communication with recess 13. Recess 13 includes a bottom face 133 that forms an outer face of partitioning wall 123 and that is intermediate first and second faces F1 and F2 in the thickness direction. Recess 13 further includes a peripheral face 134 extending substantially perpendicularly to bottom face 133. Furthermore, an engaging groove 131 is formed in peripheral face 134 and includes a first side wall 135 extending from and coplanar to bottom face 133, a second side wall 138 parallel to and spaced from first side wall 135, and an arcuate end wall 136 extending between first and second side walls 135 and 138. Second side wall 138 extends perpendicularly between arcuate end wall 136 and peripheral face 134. Engaging groove 131 can be formed by milling using a cutter, providing a space for receiving a portion of a dustproof cap 30.

A drive member 21 is received in compartment 121 and has a coupling portion 211 extending out of compartment 121 and a cylindrical portion having a larger diameter and rotatably received in compartment 121. A toothed portion 213 is formed on an outer periphery of the cylindrical portion. A stepped portion 212 is formed at an intersection of the cylindrical portion and coupling portion 211. An annular groove 214 is formed in the outer periphery of the cylindrical portion and between stepped portion 212 and toothed portion 213. Annular groove 214 is aligned with annular groove 126 and engaging groove 131 of recess 13. Drive member 21 includes a longitudinal through-hole 2151 extending along a longitudinal axis thereof perpendicular to the longitudinal axis of handle 11. Through-hole 2141 has an enlarged section 2152. A push rod 20 is received in through-hole 2151 and includes a smaller actuating section 201. A spring 202 is mounted in enlarged section 2152 and around actuating section 201. A ball 23 is mounted in coupling portion 211 for engagement with a workpiece such as a socket. Push rod 20 can be pushed to release ball 23, allowing disengagement of the workpiece from coupling portion 211. Drive member 21 is received in compartment 121 with a top edge abutting an inner face of annular end wall 122 and with toothed portion 213 aligned with first groove 124. One or more pawl 22 is slideably received in the first groove 124 and slideably supported by an inner face of partitioning wall 123 opposite to the outer face of partitioning wall 123. Pawl 22 includes a toothed portion 221 and an arcuate actuation portion 222. A switch 15 is rotatably received in second groove 125 and includes a stem 151 extending beyond first side F1 for manual operation. Switch 15 further includes an actuation end 152 abutting against actuation portion 222. When stem 151 is manually rotated between two positions, actuation portion 222 is actuated such that toothed portion 221 is selectively in one of first and second engagement relations with toothed portion 213 to allow drive member 21 to drive an object coupled with coupling portion 211 in one of two opposite directions. A C-clip 24 is mounted in annular grooves 214 and 126 and includes two hook-shaped clamping portions 241 received in recess 13. Drive member 21 is rotatably retained in compartment 121 by C-clip 24. It can be appreciated that C-clip 24 can be of other forms and shapes for rotatably retaining drive member 21 in compartment 121 according to the teachings of the present invention.

In ratchet wrench 10 according to the preferred teachings of the present invention, stepped portion 212 of drive member 2 includes a flange 2121 having an outer diameter larger than a maximum outer diameter of drive member 21. Flange 2121 includes an inner end face 2122 facing bottom face 133 of recess 13. Flange 2121 further includes an outer peripheral face 2123 extending perpendicularly to inner end face 2122. Annular groove 214 is located intermediate inner end face 2122 of flange 2121 and toothed portion 213 along the longitudinal axis of drive member 21. Engaging groove 131 is intermediate bottom face 133 of recess 13 and flange 2121 along the longitudinal axis of drive member 21. Outer peripheral face 2123 of flange 2121 is spaced from peripheral face 134 of recess 133 along the longitudinal axis of handle 11. Outer peripheral face 2123 can include a chamfered face 2124 connected to an end face of stepped portion 212.

Dustproof cap 30 includes spaced first and second faces 304 and 306 and first and second edges C1 and C2 extending between first and second faces 304 and 306. Second edge C2 is arcuate and extends between two ends of first edge C1 that is also arcuate. A protrusion 301 is formed on first edge C1. Two evasive grooves 302 are formed on two ends of second face 306 and each have a depth in the thickness direction larger than a thickness of each clamping portions 241 of C-clip 24 in the thickness direction. Dustproof cap 30 can be formed of plastic material by injection molding, which is fast in production and inexpensive in costs.

In assembly, dustproof cap 30 is inserted into recess 13 by inserting protrusion 301 into engaging groove 131 and then forcibly moving second edge C2 across flange 2121. Chamfered face 2124 allows easy movement of dustproof cap 30 across flange 2121 into recess 13. Evasive grooves 302 receive and cover clamping portions 231 of C-clip 24. Interference between dustproof cap 30 and clamping portions 241 is avoided while allowing dustproof cap 30 to have a larger thickness in an intermediate portion between evasive portions 302, because the depth of evasive grooves 302 is larger than the thickness of clamping portions 241. First edge C1 abuts peripheral face 134, second edge C2 abuts the outer periphery of drive member 21. First face 304 abuts inner end face 2122 of flange 2121. Protrusion 301 abuts arcuate end wall 136 and second side wall 138. Recess 13 in second face F2 is, thus, covered and sealed by dustproof cap 30. Dust and debris are prevented from entering recess 13 by provision of dustproof cap 30, protecting C-clip 24 and toothed portions 213 and 221 as well as other components in head 12. Since dustproof cap 30 made of plastic material possesses certain elasticity, the abutting effect between first and second edges C1 and C2, first face 304, and protrusion 301 of dustproof cap 30 and associated portions of recess 13 and drive member 21 is enhanced, further enhancing the dustproof effect.

When maintenance is required, dustproof cap 30 can be removed from recess 13. Then, a user can use a pair of pliers to release C-clip 24 from annular grooves 214 and 126 and recess 13 by clamping one of clamping portions 241, allowing removal of drive member 21 from compartment 121 for maintenance. After maintenance, a new dustproof cap 30 can be inserted into recess 13 for dustproof effect. Since dustproof cap 30 is inexpensive, the maintenance costs are significantly reduced.

Figure 9:
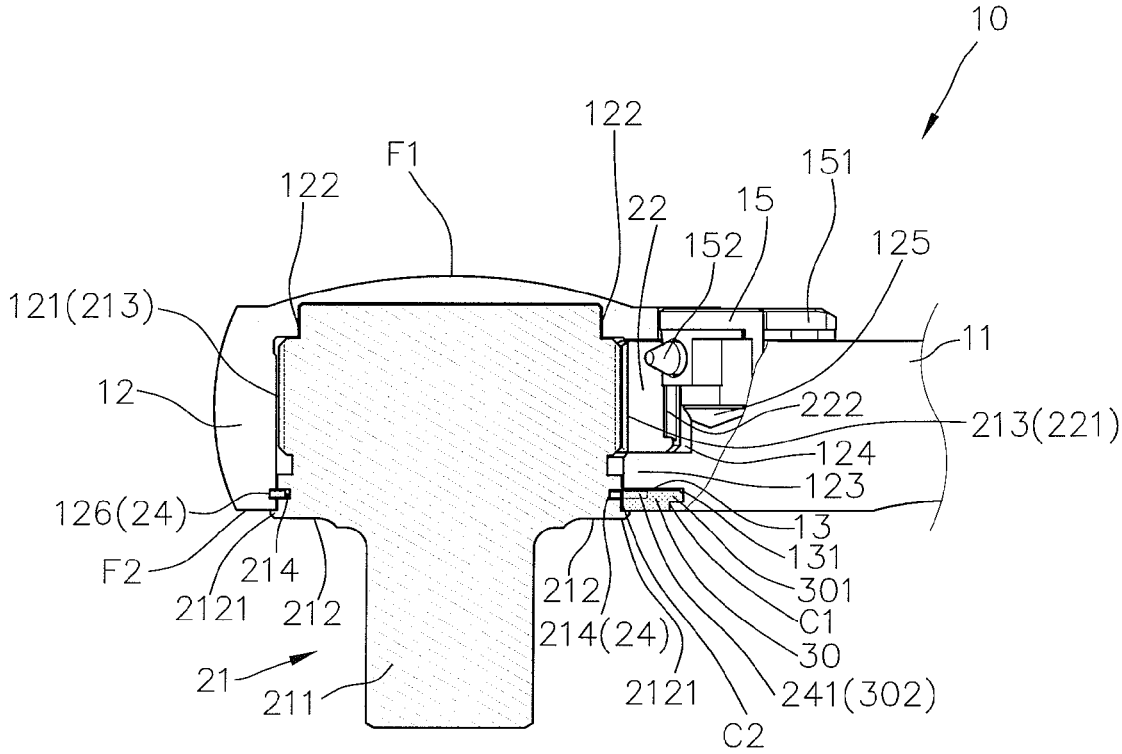
FIG. 9 shows a partially cross-sectioned side view of a portion of a ratchet wrench of another embodiment according to the preferred teachings of the present invention.

Ratchet wrench 10 according to the preferred teachings of the present invention can have other forms and shapes. In an example shown in FIG. 9, compartment 121 does not extend through first side F1 of head 12. Furthermore, drive member 21 does not include push rod 20, through-hole 2151, spring 202, and ball 23 in through-hole 2151.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a handle (11) having a longitudinal axis;

a head (12) connected to an end of the handle (11), with the head (12) including first and second sides (F1, F2) spaced in a thickness direction perpendicular to the longitudinal axis of the handle (11), with a compartment (121) extending from the second side (F2) towards the first side (F1), with the compartment (121) including an inner periphery, with a first groove (124) formed in the inner periphery of the compartment (121), with the head (12) further including a second groove (125) in communication with the first groove (124), with a recess (13) formed in the second side (F2) of the head (12), with a first annular groove (126) formed in the inner periphery of the compartment (121) and in communication with the recess (13), with the recess (13) including a bottom face (133) intermediate the first and second sides (F1, F2) in the thickness direction, with the recess (13) further including a peripheral face (134) extending perpendicularly to the bottom face (133);

a drive member (21) rotatably received in the compartment (121), with the drive member (21) including an outer periphery with a toothed portion (213), with the drive member (21) further including a coupling portion (211) adapted to engage with an object to be driven, with a second annular groove (214) formed in the outer periphery of the drive member (21) and aligned with the first annular groove (126), with a flange (2121) formed on the outer periphery of the drive member (21) and intermediate the coupling portion (211) and the second annular groove (214), with the flange (2121) including an inner end face (2122) facing the bottom face (133) of the recess (13), with the second annular groove (214) located intermediate the inner end face (2122) of the flange (2121) and the toothed portion (213);

a C-Clip (24) received in the first and second annular grooves (126, 214) and rotatably retaining the drive member (21) in the compartment (121), with the C-clip (24) including two clamping portions (241) received in the recess (13);

a pawl (22) slideably received in the first groove (124), with the pawl (22) selectively in one of first and second engagement relations with the toothed portion (213) to allow the drive member (21) to drive an object coupled with the coupling portion (211) in one of two opposite directions;

a switch (15) received in the second groove (125) and operatively connected to the pawl (22), with the switch (15) rotatable to move the pawl (22) to be selectively in the first or second engagement relation with the toothed portion (213) of the drive member (21); and dustproof cap (30) engaged in the recess (13) and located intermediate the bottom face (133) of the recess (13) and the inner end face (2122) of the flange (2121), with the dustproof cap (30) covering the two clamping portions (241) of the C-clip (24) and covering and sealing the recess (13).

2. The ratchet wrench as claimed in claim 1, with the recess (13) further including an engaging groove (131) formed in the peripheral face (134), with the engaging groove (131) including a first side wall (135) extending from and coplanar to the bottom face (133), with the engaging groove (131) further including a second side wall (138) parallel to and spaced from the first side wall (135), with the engaging groove (131) further including an end wall (136) extending between the first and second side walls (135, 138), with the second side wall (138) extending perpendicularly between the end wall (136) and the peripheral face (133), with the dustproof cap (30) including a protrusion (301) engaged in the engaging groove (131).

3. The ratchet wrench as claimed in claim 2, with the dustproof cap (30) including first and second faces (304, 306), with the second face (306) of the dustproof cap (30) including two evasive grooves (302), with the two evasive grooves (302) receiving the two clamping portions (241) of the C-clip (24).

4. The ratchet wrench as claimed in claim 3, with each of the two evasive grooves (302) having a depth in the thickness direction larger than a thickness of each of the two clamping portions (241) of the C-clip (24) in the thickness direction.

5. The ratchet wrench as claimed in claim 3, with the dustproof cap (30) including first and second faces (304, 306) spaced in the thickness direction, with the dustproof cap (30) further including first and second edges (C1, C2) extending between the first and second faces (304, 306), with the protrusion (301) formed on the first edge (C1).

6. The ratchet wrench as claimed in claim 5, with the end wall (136) being arcuate, with the protrusion (301) abutting the arcuate end wall (136) and the second side wall (138).

7. The ratchet wrench as claimed in claim 6, with the second edge (C2) abutting the outer periphery of the drive member (21), with the first face (304) of the dustproof cap (30) abutting the inner end face (2122) of the flange (2121), with the first edge (C1) abutting the peripheral face (134).

8. The ratchet wrench as claimed in claim 7, with the first edge (C1) being arcuate and having two ends, with the second edge (C2) being arcuate and extending between the two ends of the first edge (C1).

9. The ratchet wrench as claimed in claim 8, with the flange (2121) including an outer peripheral face (2123) extending perpendicularly to the inner end face (2122) of the flange (2121), with the outer peripheral face (2123) of the flange (2121) located intermediate the first and second edges (C1, C2) along the longitudinal axis of the handle (11).

10. The ratchet wrench as claimed in claim 9, with the outer peripheral face (21240 including a chamfered face (2124).

11. The ratchet wrench as claimed in claim 9, with the first groove (124) spaced from the recess (13) by a partitioning wall (123), with the bottom face (133) forming an outer face of the partitioning wall (123), with the pawl (22) slideably supported by an inner face of the partitioning wall (123) opposite to the outer face of the partitioning wall (123).

* * * * *